US008413294B2

(12) United States Patent
Lee

(10) Patent No.: US 8,413,294 B2
(45) Date of Patent: Apr. 9, 2013

(54) FAN MOTOR UNIT AND VACUUM CLEANER HAVING THE SAME

(75) Inventor: Byung-Jo Lee, Gwangju (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 371 days.

(21) Appl. No.: 12/813,801

(22) Filed: Jun. 11, 2010

(65) Prior Publication Data

US 2011/0005029 A1 Jan. 13, 2011

(30) Foreign Application Priority Data

Jul. 8, 2009 (KR) ..... 10-2009-0061973

(51) Int. Cl.
*A47L 9/22* (2006.01)

(52) U.S. Cl. ..... 15/412; 15/339; 15/413

(58) Field of Classification Search ..... 15/412, 15/363, 339, 413
See application file for complete search history.

(56) References Cited

U.S. PATENT DOCUMENTS

| | | | | |
|---|---|---|---|---|
| 3,381,652 | A * | 5/1968 | Schaefer | 116/268 |
| 5,974,623 | A * | 11/1999 | Cummins et al. | 15/347 |
| 6,807,709 | B2 * | 10/2004 | Fernandez-Grandizo Martinez | 15/413 |
| 7,278,180 | B2 * | 10/2007 | Pyeong | 15/412 |
| 7,614,113 | B2 * | 11/2009 | Roney et al. | 15/412 |
| 8,046,869 | B2 * | 11/2011 | Oh et al. | 15/326 |
| 2003/0070254 | A1 * | 4/2003 | Ji | 15/412 |
| 2006/0117518 | A1 * | 6/2006 | Hwang | 15/326 |
| 2008/0098561 | A1 * | 5/2008 | Oh et al. | 15/326 |

FOREIGN PATENT DOCUMENTS

| | | |
|---|---|---|
| EP | 1 929 915 | 6/2008 |
| KR | 10-2003-0031575 | 4/2003 |
| KR | 10-2006-0002369 | 1/2006 |
| KR | 10-0711063 | 4/2007 |

OTHER PUBLICATIONS

United Kingdom Search Report issued on Oct. 22, 2010, in corresponding United Kingdom Patent Application No. GB 1011104.5 (4 pages).

* cited by examiner

*Primary Examiner* — Basil Katcheves
*Assistant Examiner* — Beth Stephan
(74) *Attorney, Agent, or Firm* — NSIP Law

(57) ABSTRACT

A fan motor unit and a vacuum cleaner having the same are provided. The fan motor unit includes a motor assembly comprising an impeller and a motor, a first upper case configured to surround the motor assembly, the first upper case comprising an inlet tube in communication with an entry of the impeller, configured to a first lower case configured to surround a lower portion of the motor assembly, a damper and a pressure switch, each in communication with the inlet tube and, a warning member connected to the pressure switch, wherein when the pressure of the interior pressure of the motor assembly is below a predetermined value, external air is flowed through the damper and a warning is generated by the warning member and the pressure switch.

10 Claims, 5 Drawing Sheets

FAN MOTOR UNIT AND VACUUM CLEANER HAVING THE SAME

CROSS-REFERENCE TO RELATED APPLICATION(S)

This application claims the benefit under 35 U.S.C. §119 (a) of Korean Patent Application No. 10-2009-0061973, filed on Jul. 8, 2009, in the Korean Intellectual Property Office, the entire disclosure of which is incorporated herein by reference for all purposes.

BACKGROUND

1. Field

The following description relates to a vacuum cleaner, and more particularly, to a fan motor unit having a motor protection function and a vacuum cleaner having the same.

2. Description of the Related Art

In general, vacuum cleaners may have a fan motor unit mounted therein which may serve to draw in a stream of air so as to remove foreign substances such as dust on a surface to be cleaned.

The fan motor unit generates a suction force by exhausting air in the vacuum cleaner to the exterior of the vacuum cleaner to lower internal pressure. The generated suction force allows foreign substances, such as dust on a surface to be cleaned, together with external air, through a suction unit, such as a brush assembly or nozzle, and the foreign substances may be separated from the external air by a dust separating apparatus having a centrifugal separator, a dust bag, or the like.

When a portion of a flow path of a vacuum cleaner is clogged by foreign substances during the use of the vacuum cleaner, the internal pressure of the vacuum cleaner is rapidly decreased. If the internal pressure of the vacuum cleaner is decreased, the output of a motor is increased so that exhaustion is actively performed, and therefore, overload may be applied to the motor. If heat generated from the motor, to which the overload is applied, is not quickly dissipated, the driving of the motor may be stopped, or the motor may be damaged.

Also, the flow rate of air flowing via a PCB substrate mounted in the vacuum cleaner may be decreased, and heat generated from the substrate having a heater element may not be cooled down quickly. Therefore, the driving of the substrate may be stopped, or the substrate may be damaged.

Accordingly, the following references seek to address the problem where the internal pressure of a vacuum cleaner is lowered by the clogging of a flow path.

For example, Korean Patent No. 432730 ("KR '730"), Korean Patent Publication No. 2006-2369 ("KR '369"), Korean Patent No. 711063 ("KR '063"), aim to address the above described problem.

However, the aforementioned references are not still unsatisfactory in the functional-structural view, for example, in that the overload of a motor is quickly prevented, that the notice for an appropriate measure is quickly given to a user, and the like.

SUMMARY

In one general aspect, there is provided a fan motor unit including a motor assembly comprising an impeller and a motor, a first upper case configured to surround the motor assembly, the first upper case comprising an inlet tube in communication with an entry of the impeller, configured to a first lower case configured to surround a lower portion of the motor assembly, a damper and a pressure switch, each in communication with the inlet tube, and a warning member connected to the pressure switch, wherein when the pressure of the interior pressure of the motor assembly is below a predetermined value, external air is flowed through the damper and a warning is generated by the warning member and the pressure switch.

The first upper case may be further provided with a PCB hole connected to the inlet tube to cool down a printed circuit board.

The first upper case may be provided with a damper duct for connecting the inlet tube and the damper to each other, a switch duct for connecting the inlet tube and the pressure switch to each other, and a cooling duct for connecting the inlet tube and the PCB hole to each other.

The damper duct, the switch duct and the cooling duct may be connected to a portion close to the entry of the impeller in the inlet tube.

The damper may be formed to protrude to an outer surface of the first upper case so that external air is flowed into the fan motor unit therethrough.

The fan motor unit may further include a second upper case and a second lower case, formed to surround the motor assembly. In the fan motor unit, the second upper and lower cases may be respectively mounted in the first upper and lower cases.

The inlet tube may be formed to protrude upward from the center of the first upper case.

A plurality of outlet holes may be distributedly formed at the first upper case so that gas exhausted from the motor assembly is distributed and exhausted therethrough.

The user may be notified of the lowered pressure through the pressure switch.

In another aspect, there is provided a vacuum cleaner including a main body, a brush assembly connected to the main body, a fan motor unit mounted in the main body, the fan motor unit comprising, a motor assembly having an impeller and a motor, a first upper case configured to surround the motor assembly, the first upper case comprising an inlet tube in communication with an entry of the impeller, a first lower case configured to surround a lower portion of the motor assembly, a damper and a pressure switch, each in communication with the inlet tube, and a warning member connected to the pressure switch. When the pressure of the interior pressure of the motor assembly is below a predetermined value, external air is flowed through the damper and a warning is generated by the warning member and the pressure switch.

The vacuum cleaner may further include a prefilter unit and an outlet filter unit, connected to an upper portion of the fan motor unit. In the vacuum cleaner, the outlet filter unit may be connected between the fan motor unit and the prefilter unit so that air flowed downwardly into the inlet tube and the fan motor unit through the prefilter unit is again raised and then exhausted through the outlet filter unit.

The first upper case may be further provided with a PCB hole connected to the inlet tube to cool down a printed circuit board.

Other features and aspects will be apparent from the following detailed description, the drawings and the claims.

Figure 1:
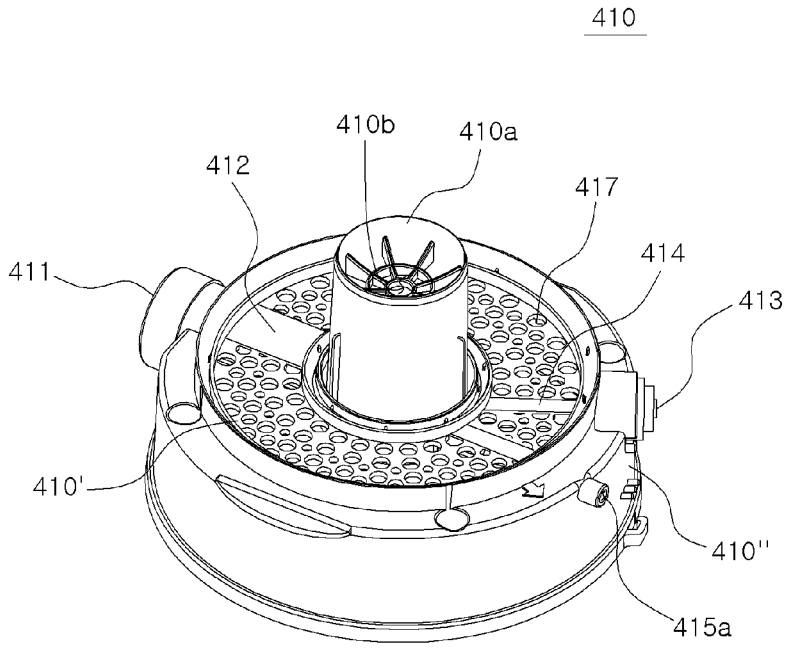
FIG. 1 is a plan perspective view of an example of a first upper case.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following detailed description is provided to assist the reader in gaining a comprehensive understanding of the methods, apparatuses, and/or systems described herein. Accordingly, various changes, modifications, and equivalents of the systems, apparatuses, and/or methods described herein will be suggested to those of ordinary skill in the art. The progression of processing steps and/or operations described is an example; however, the sequence of and/or operations is not limited to that set forth herein and may be changed as is known in the art, with the exception of steps and/or operations necessarily occurring in a certain order. Also, descriptions of well-known functions and constructions may be omitted for increased clarity and conciseness.

Figure 2:
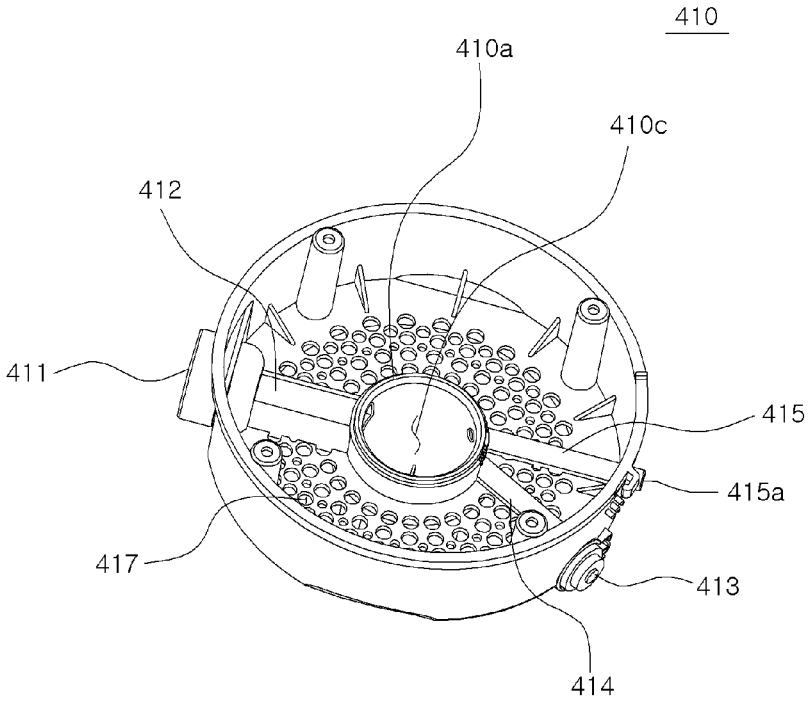
FIG. 2 is a bottom perspective view of the example of the first upper case.
Figure 3:
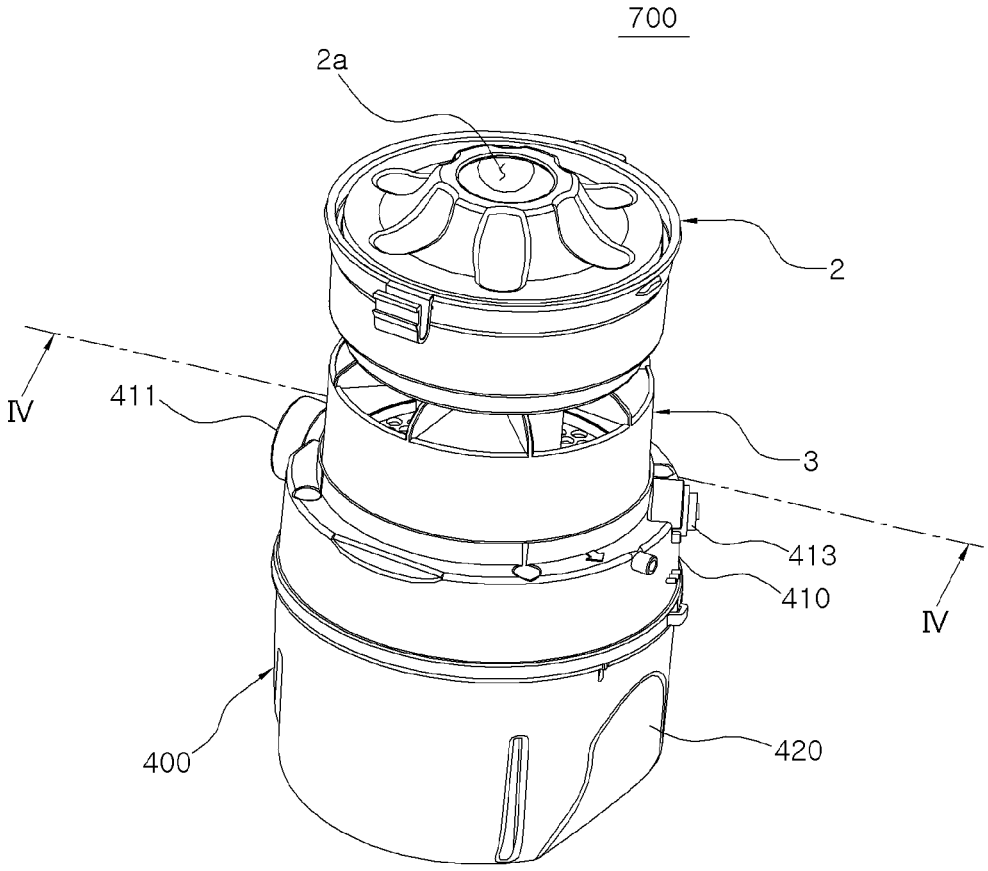
FIG. 3 is a partial exploded perspective view of an example of an inlet/outlet assembly having a fan motor unit to which the first upper case is connected.
Figure 4:
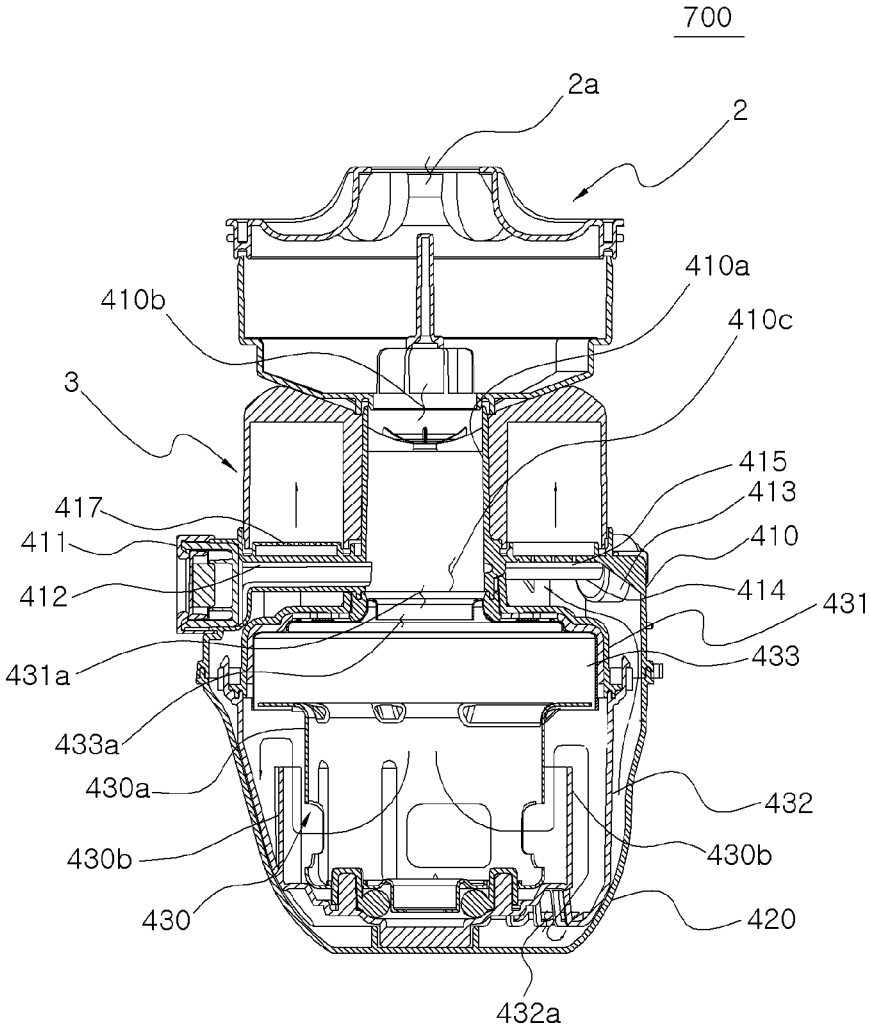
FIG. 4 is a sectional view of the example of the inlet/outlet assembly taken along line IV-IV of FIG. 3.

FIG. 1 illustrates a plan perspective view of an example of a first upper case 410. FIG. 2 illustrates a bottom perspective view of the example of the first upper case 410. FIG. 3 illustrates a partial exploded perspective view of an example of an inlet/outlet assembly 700 having a fan motor unit 400 to which the first upper case is connected, a prefilter unit 2 and an outlet filter unit 3. FIG. 4 illustrates a sectional view of the example of the inlet/outlet assembly 700 taken along line IV-IV of FIG. 3.

Referring to FIGS. 1 to 4, for the purposes of example, the inlet/outlet assembly 700 includes a prefilter unit 2, an outlet filter unit 3 and a fan motor unit 400. The fan motor unit 400 includes a motor assembly 430, a first upper case 410, a first lower case 420, a second upper case 431, a second lower case 432, a damper 411 and a pressure switch 413. As shown in FIG. 4, the motor assembly 430 has an impeller 433 and a motor 430*a*.

As shown in FIGS. 1 and 2, a first upper case 410 includes an upper surface 410' and a cylindrical sidewall 410" integrally connected to the upper surface 410'.

The upper surface 410' has an inlet tube 410*a* for forming an inlet flow path, a plurality of outlet holes 417, a damper duct 412, a switch duct 414 and a cooling duct 415 with a PCB hole 415*a*. A damper 411 and a pressure switch 413 are formed at the sidewall 410" to be exposed to the exterior of the first upper case 410.

The inlet tube 410*a* is formed to protrude upward from the center of the upper surface 410' by passing through the upper surface 410'. The upper portion of the inlet tube 410*a* forms an inlet port 410*b* of the inlet tube 410*a*, and the lower portion of the inlet tube 410*a* forms an outlet port 410*c* of the inlet tube 410*a*.

The plurality of outlet holes 417 are formed to be uniformly distributed over the entire region of the upper surface 410' at the exterior of the inlet tube 410*a* so that air exhausted from the fan motor unit 400 may be uniformly distributed and exhausted upward.

One end portion of the damper duct 412 is communicated with the inlet tube 410*a*, and the other end portion of the damper duct 412 is connected to the damper 411 to protrude outward from the first upper case 410.

One end portion of the switch duct 414 is communicated with the inlet tube 410*a*, and the other end portion of the switch duct 414 is connected to the pressure switch 413.

One end portion of the cooling duct 415 is communicated with the inlet tube 410*a*, and the other end portion of the cooling duct 415 is protruded outward from the sidewall 410" as a PCB hole 415*a*. The PCB hole 415*a* is communicated with a substrate mounting portion (not shown) formed on a PCB substrate (formed at the exterior of the fan motor unit 400 and not shown) having a heat emitting member. Thus, the suction force of the inlet tube 410*a* may be transmitted to the substrate mounting portion (not shown) on which the PCB substrate and a heat sink (not shown) are mounted through the PCB hole 415*a*. Accordingly, external air may be flowed into the inlet tube 410*a* through the substrate mounting portion (not shown), the PCB hole 415*a* and the cooling duct 415, so that the temperature of the PCB substrate may be cooled down.

Figure 5:
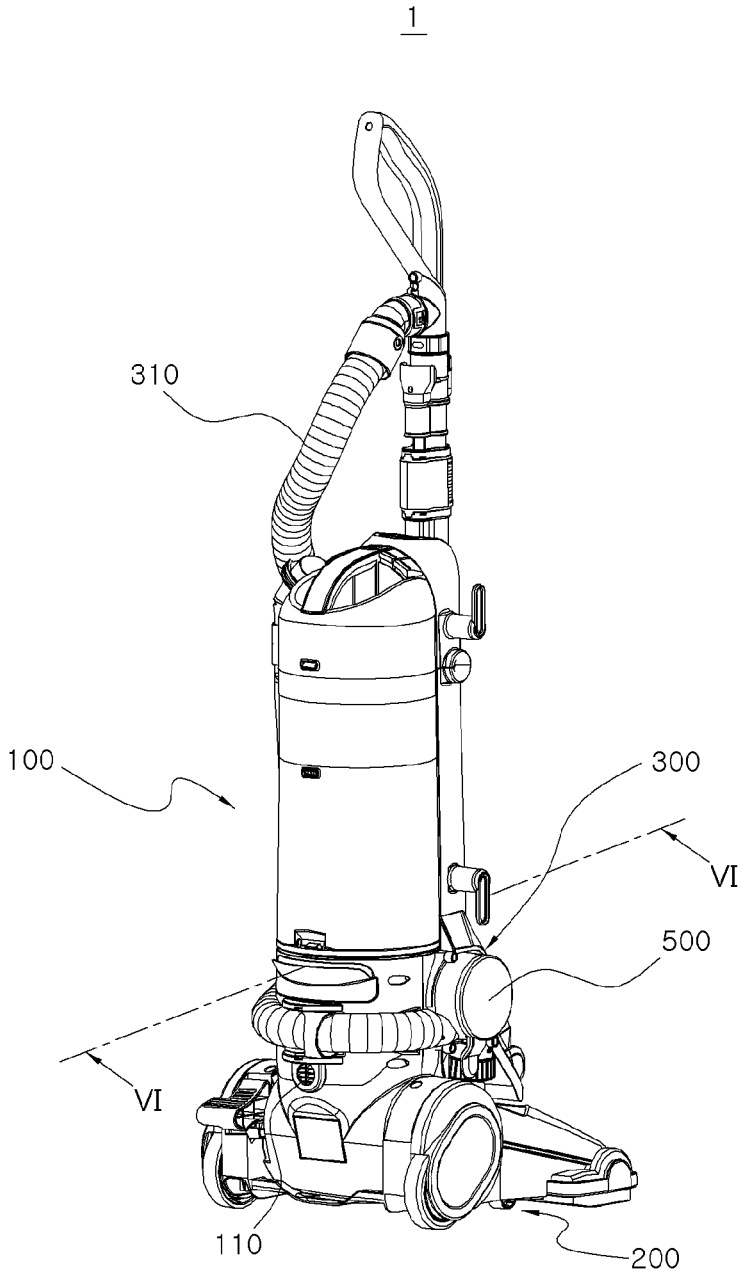
FIG. 5 is a rear perspective view of an example vacuum cleaner having the fan motor unit of FIG. 3.
Figure 6:
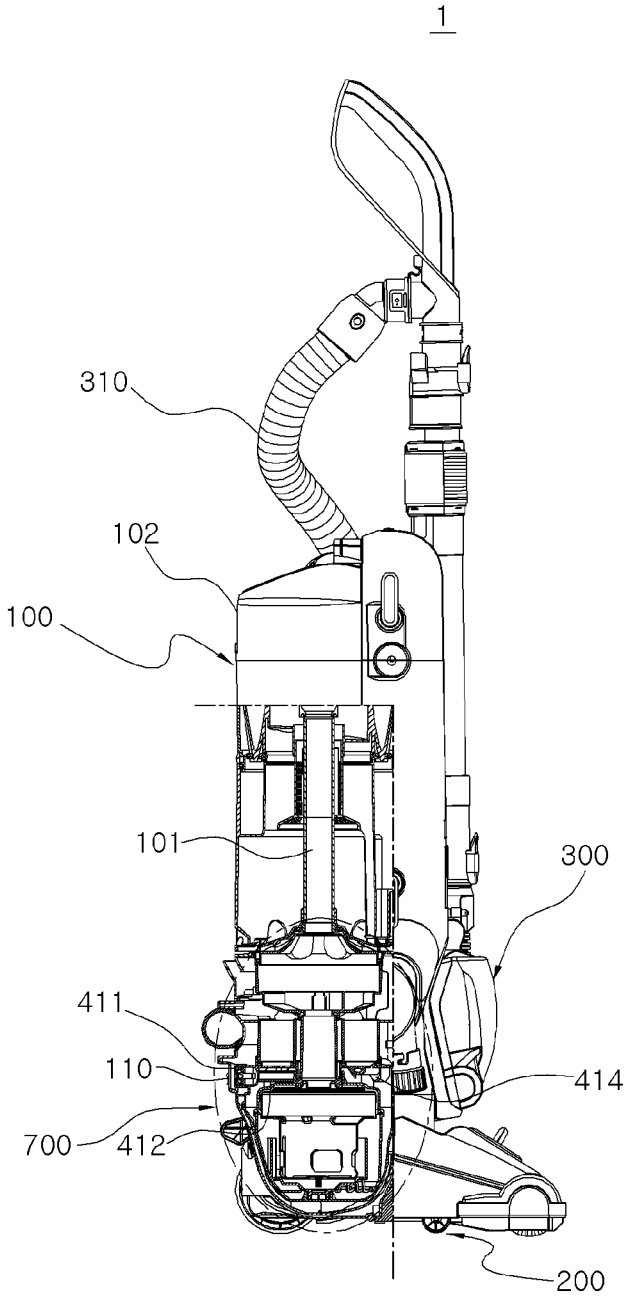
FIG. 6 is a partial perspective view of the example of the vacuum cleaner taken along a vertical plane passing through line VI-VI of FIG. 5.

When the internal pressure of the inlet tube 410*a* transmitted by the switch duct 414 is blow a predetermined pressure, light is emitted from the warning lamp electrically connected to the pressure switch 413(see FIG. 5 and FIG. 6).

The configuration of the damper 411 and the pressure switch 413 may be applied to all configurations known in the related arts, and therefore, further description is omitted.

The damper 411, the damper duct 412, the cooling duct 415, the pressure switch 413 and the switch duct 414 may be integrally formed with the first upper case 410.

As shown in the examples of FIGS. 3 and 4, the first lower case 420 is formed in a cylindrical shape, and is connected to the first upper case 410.

As shown in FIG. 4, the second upper case 431 has a motor inlet hole 431*a* formed at an upper surface thereof, and accommodates the impeller 433 therein. For example, the motor inlet hole 431*a* communicates the inlet tube 410*a* with an entry 433*a* of the impeller 433. The second lower case 432 has a cylindrical structure with an outlet hole 432*a*.

The second lower case 432 has a cylindrical internal motor case 430*b* formed therein. The internal motor case 430*b* is connected to a lower outer circumferential edge of the motor 430*a* so as to form an outlet flow path of the motor 430*a* and may reduce noise generated from the motor 430*a*. The second lower case 432 accommodates and fixes the motor 430*a* so that the outlet flow path of air exhausted from the motor 430*a* is formed together with the internal motor case 430*b*.

The second upper case 431 is connected to the second lower case 432, and is connected to the first upper case 410 and the first lower case 420 so that the entry 433*a* of the impeller 433 is communicated with the outlet port 410*c* of the inlet tube 410*a*.

The outlet filter unit 3 is connected to the fan motor unit 400 at an upper portion of the fan motor unit 400. Here, the outer filter unit 3 is connected to the fan motor unit 400 by allowing the outer circumferential edge to be inserted thereinto. The prefilter unit 2 is connected to the outlet filter unit 3 at an upper portion of the outlet filter unit 3. Here, the prefilter unit 2 is blocked with the outlet filter unit 3 and is communicated with the inlet tube 410*a*.

FIG. 5 illustrates a rear perspective view of an example of a vacuum cleaner 1 having the fan motor unit 400 of FIG. 3.

FIG. 6 illustrates a partial perspective view of an example of the vacuum cleaner 1 taken along a vertical plane passing through line VI-VI of FIG. 5.

Referring to FIGS. 5 and 6, the fan motor unit 400 is mounted in a main body 100 of the vacuum cleaner 1.

The vacuum cleaner 1 includes the main body, and a main brush assembly 200 and an auxiliary brush assembly 300, connected to a flow path changing apparatus for selectively connecting a flow path to a dust condensing apparatus 102.

The main brush assembly 200 is connected to the flow path changing apparatus 500 through a separate flow path pipe (not shown), and the auxiliary brush assembly 300 is connected to the flow path changing apparatus 500 through a hose 310.

The dust condensing apparatus 102 connected to the flow path changing apparatus 500 is formed in the interior of the main body 100, and an outlet tube 101 of the dust condensing apparatus 102 is communicated with an entry 2*a* (see FIG. 4) of the prefilter unit 2 at a lower portion of the dust condensing apparatus 102.

A damper exposing hole 110 through which the damper 411 is exposed to the exterior of the vacuum cleaner 1 is formed at a rear surface of the main body 100. If the inlet/outlet assembly 700 is mounted in the interior of the main body 100, the damper 411 is positioned to face the damper exposing hole in the interior of the main body 100, so that it is directly communicated with the exterior of the vacuum cleaner 1.

Hereinafter, the motor protecting, pressure displaying and cooling functions of the first upper case 410 are described in the vacuum cleaner 1 having the aforementioned structure.

If the motor assembly 430 in the vacuum cleaner 1 is driven, the impeller 433 is rotated by the rotation force of the motor 430*a*, thereby generating a suction force. The suction force generates the flow of air that passes through the main brush assembly 200 connected to the flow path changing apparatus 500, the dust condensing apparatus 102, the prefilter unit 2, the fan motor unit 400 and the outlet filter unit 3.

The air flowed, or drawn, into the dust condensing apparatus 102 is drawn into the prefilter unit 2 after foreign substances are separated from the air. The air from which dust is separated by the prefilter unit 2 is flowed downwardly into the fan motor unit 400 through the inlet tube 410*a* of the first upper case 410 and raised again. Then, the air is exhausted to the exterior of the fan motor unit 400 through the outlet filter unit 3.

The outlet filter unit 3 filters dust, for example, carbon powder of a carbon brush produced in the interior of the fan motor unit 400, and the like that may not filtered by the prefilter unit 2.

The damper 411 is configured to be exposed to the exterior of the vacuum cleaner 1 through the damper exposing hole 110. The damper duct 412 is configured to directly communicate with the inlet tube 410*a* at a position adjacent to the outlet port 410*c* of the inlet tube 410*a*. Accordingly, when an overload is applied to the motor 430*a* due to the reduction of pressure in the vacuum cleaner 1, the pressure is rapidly transmitted to the damper 411, and the damper 411 is quickly opened. External air of the vacuum cleaner 1 is directly flowed into the entry 433*a* of the impeller 433 in the fan motor unit 400 through the opened damper 411, so that the overload of the motor 430*a* may be solved quickly. Since low-temperature external air of the vacuum cleaner 1 is directly flowed through the damper exposing hole 110, heat generated from the motor 430*a* may be cooled down rapidly.

Since the cooling duct 415 is directly communicated with the interior of the inlet tube 410*a* positioned adjacent to the entry 433*a* of the impeller 433, the flow rate and amount of the air flowed through the cooling duct 415 may be increased by the low pressure of the inlet tube 410*a*. Accordingly, the cooling efficiency of a substrate (not shown) may be enhanced as compared with structures in which the substrate mounting portion is not directly communicated with the inlet tube.

Since the switch duct 414 is also communicated directly with the interior of the inlet tube 410*a* positioned adjacent to the entry 433*a* of the impeller 433, the pressure of the entry 433*a* of the impeller 433 may be quickly transmitted to the pressure switch 410 connected to the inlet tube 410*a*, and the pressure switch 413 may be precisely and rapidly operated. Accordingly, the warning lamp produces light and a user may take an immediate measure (see FIG. 5 and FIG. 6).

Although it has been described in this example that an upright type vacuum cleaner is used, this example may be variously applied to all kinds of vacuum cleaners with a hose, such as a canister type vacuum cleaner, a backpack type vacuum cleaner and a handy vacuum cleaner, for example.

When a motor is overloaded, the overload of the motor may be solved quickly, and a user may be quickly notified of the motor's state.

The temperature of a heating element on the PCB substrate may be maintained to a proper level, and air may be flowed around the PCB substrate as long as the flow path of the motor or inlet tube is not clogged.

A number of examples have been described above. Nevertheless, it will be understood that various modifications may be made. For example, suitable results may be achieved if the described techniques are performed in a different order and/or if components in a described system, architecture, device, apparatus or circuit are combined in a different manner and/or replaced or supplemented by other components or their equivalents. Accordingly, other implementations are within the scope of the following claims.

What is claimed is:

1. A fan motor unit for a vacuum cleaner, comprising:

a motor assembly comprising an impeller and a motor;

a first upper case surrounding the motor assembly, the first upper case comprising an inlet tube in communication with an entry of the impeller;

a first lower case surrounding a lower portion of the motor assembly; and a damper and a pressure switch, each in communication with the inlet tube, wherein, when the interior, pressure of the motor assembly is less than a predetermined value, external air is flowed through the damper and a user is notified of the lowered pressure; and the first upper case is further provided with a PCB hole connected to the inlet tube to cool down a printed circuit board.

2. The fan motor unit of claim 1, wherein the first upper case is provided with:

a damper duct that connects the inlet tube and the damper to each other;

a switch duct that connects the inlet tube and the pressure switch to each other; and a cooling duct that connects the inlet tube and the PCB hole to each other.

3. The fan motor unit of claim 2, wherein the damper duct, the switch duct and the cooling duct are each connected to the inlet tube in a lower portion of the inlet tube that connects to the entry of the impeller.

4. The fan motor unit of claim 1, wherein the damper protrudes to an outer surface of the first upper case such that external air is flowed into the fan motor unit therethrough.

5. The fan motor unit of claim 1, further comprising a second upper case and a second lower case, that surround the motor assembly, the second upper and lower cases being respectively mounted in the first upper and lower cases.

6. The fan motor unit of claim 1, wherein the inlet tube protrudes upward from the center of the first upper case.

7. The fan motor unit of claim 1, further comprising a plurality of outlet holes formed at the first upper case such that gas exhausted from the motor assembly is distributed and exhausted therethrough.

8. A vacuum cleaner comprising:

a main body;

a brush assembly connected to the main body;

a fan motor unit mounted in the main body, the fan motor unit comprising:

a motor assembly having an impeller and a motor;

a first upper case surrounding the motor assembly, the first upper case comprising an inlet tube in communication with an entry of the impeller;

a first lower case surrounding a lower portion of the motor assembly;

a damper and a pressure switch, each in communication with the inlet tube; and a prefilter unit and an outlet filter unit, each connected to an upper portion of the fan motor unit, wherein, when the interior pressure of the motor assembly is less than a predetermined pressure, external air is flowed through the damper, and a user is notified of the lowered pressure through the pressure switch; and the outlet filter unit is connected between the fan motor unit and the prefilter unit such that air flowed downwardly into the inlet tube and the fan motor unit through the prefilter unit is again raised and then exhausted through the outlet filter unit.

9. The vacuum cleaner of claim 8, wherein the first upper case further comprises a PCB hole connected to the inlet tube and configured to cool down a printed circuit board.

10. The fan motor unit of claim 1, wherein the user is notified of the lowered pressure through the pressure switch.

* * * * *